US006041578A

United States Patent [19]

Romagnoli

[11] Patent Number: 6,041,578

[45] Date of Patent: Mar. 28, 2000

[54] STACKING DEVICE FOR PACKAGING MACHINES TO FORM GROUPS OF PRODUCTS ARRANGED SIDE TO SIDE AND TO INSERT THE GROUPS INTO CARTONS

[75] Inventor: Andrea Romagnoli, San Lazzaro di Savena, Italy

[73] Assignee: Tecnomeccanica S.r.l., Bologna, Italy

[21] Appl. No.: 08/947,998

[22] Filed: Oct. 9, 1997

[30] Foreign Application Priority Data

Nov. 8, 1996 [IT] Italy ..... BO96A0568

[51] Int. Cl.[7] ..... B65B 35/50

[52] U.S. Cl. ..... 53/540; 53/495; 53/500; 53/542

[58] Field of Search ..... 53/493, 495, 498, 53/500, 535, 540, 542

[56] References Cited

U.S. PATENT DOCUMENTS

| | | | |
|---|---|---|---|
| 3,139,714 | 7/1964 | Hall | 53/540 |
| 3,435,584 | 4/1969 | Prechter | 53/542 X |
| 3,593,837 | 7/1971 | Loomis | 53/540 X |
| 3,657,860 | 4/1972 | Franklin | 53/535 |
| 3,670,474 | 6/1972 | Vieson et al. | 53/540 X |
| 3,815,316 | 6/1974 | Brooke | 53/526 X |
| 3,854,270 | 12/1974 | Cloud et al. | 53/540 |
| 3,890,764 | 6/1975 | Hartman | 53/542 X |
| 4,492,070 | 1/1985 | Morse et al. | 53/529 X |
| 5,022,218 | 6/1991 | Prakken | 53/540 X |
| 5,235,796 | 8/1993 | Campbell et al. | 53/542 X |
| 5,548,945 | 8/1996 | Nippes | 53/542 X |
| 5,765,337 | 6/1998 | Lodewegen et al. | 53/540 X |

FOREIGN PATENT DOCUMENTS

| | | |
|---|---|---|
| 644119 | 3/1995 | European Pat. Off. . |
| BO95A0574 | 12/1995 | Italy . |
| 2113641 | 8/1983 | United Kingdom . |
| 2165203 | 4/1986 | United Kingdom . |

*Primary Examiner*—Daniel B. Moon
*Attorney, Agent, or Firm*—Fay, Sharpe, Fagan, Minnich & McKee

[57] ABSTRACT

The invention relates to a device for a packaging machine to form groups of products and insert them into cartons at a cartoning station. The device comprises a stacking line equipped with a controlled outfeed hopper in which an alternating product presser operates. The stacking line comprises a container located at the bottom of the hopper and having a tongue inside it designed to retain the products forming the group which thus grows downwards towards an endwall of the container. The container moves alternately from a position in which it is connected with the hopper to a position in which it is connected with the cartoning station where the group is extracted from the container and transferred to the carton. The tongue is actuated by linear actuating means synchronized with the packaging machine by programmable control means and providing the enable signal to cut off the hopper to allow the container to move to the cartoning station.

5 Claims, 3 Drawing Sheets

STACKING DEVICE FOR PACKAGING MACHINES TO FORM GROUPS OF PRODUCTS ARRANGED SIDE TO SIDE AND TO INSERT THE GROUPS INTO CARTONS

BACKGROUND OF THE INVENTION

The present invention relates to a stacking device for packaging machines to form groups of products arranged side to side and to insert the groups into cartons. The invention applies in particular to packaging machines for making tea bags or similar infusable products but, although the present description specifically refers to these products, it may also be conveniently applied to the stacking and cartoning of products of various other kinds, or their packages, having similar properties of flexibility and pliability.

In the automatic tea-bag making sector, numerous machines are known (as described, for example, in Italian patent application No. BO95A000574 made by the same Applicant as the present). These machines make a continuous tube of filter paper containing charges of infusable product and transversely sealed at regular intervals, each portion of tube thus formed containing a single charge of product. As it feeds continuously along the machine, the tube passes through a cutting station, which makes a continuous succession of tea bags by cutting the tube at regular intervals. The tea bags made in this way are stacked in groups or batches containing a predetermined number of tea bags which are then inserted into cartons.

The main problem of packaging the tea bags is to synchronize the continuous motion of the machine which makes the tea bags with the alternating motion of the one which stacks and cartons the individual groups of tea bags.

One known solution to this problem which reflects customary packaging techniques is to provide devices consisting in particular of a vertical stacking line located downstream of the cutting station and a cartoning station located beside the stacking line. The stacking line is equipped with a controlled outfeed hopper into which the continuous stream of products from the cutting station is fed. Inside the hopper, there is an alternating presser which pushes the products one by one into a container located below. Inside the container, a movable tongue actuated in such a manner as to retain the single products and push them down the container to form a stack which extends downwards towards the endwall of the container itself.

When the predetermined number of products is reached, the hopper is closed and the container moves from an initial condition in which it is connected with the hopper to a final position in which it is connected with the cartoning station. At the latter, the stack is extracted from the container and inserted into a carton, after which the container returns to the initial condition, the hopper re-opens and the sequence is repeated for the next batch of products.

To enable this sequence to be suitably synchronized with the products feeding out of the tea bag maker, known devices envisage complex mechanical systems. These consist essentially of a shaft that rotates at a speed connected with the speed of the tea bag maker, so as to enable the products forming part of the group to be counted, and separating devices which, on reaching the predetermined number of products in a batch, separate the batch on a command issued by cam-operated elements.

Although the devices of this kind operate satisfactorily, the considerable complexity of their construction involves high costs.

Another disadvantage is that it is impossible to rapidly effect size changeover by changing the number of products in a group. In fact, even if their drive systems are equipped with mechanical adjustment means which, moreover, further increase the constructional complexity of the devices as a whole, the changeover procedure requires lengthy adjustments which are economically justified only if very large numbers of batches with the same number of tea bags are to be made.

The present invention has for an object to provide a device designed to form groups of products and insert them into cartons which is simple and economical in construction and which thus overcomes the disadvantages mentioned above.

SUMMARY OF THE INVENTION

This object is achieved by providing linear actuating means to drive at least the movable tongue of the container, the linear actuating means being synchronized with the tea bag maker by programmable control means which count the tea bags and, on reaching a preset reference value, issue commands that move the container to the cartoning station, extract the stack of tea bags from the container and return the latter to the hopper.

Since the counting of the tea bags forming a group is completely independent of the movement of the container, the device has the further advantage of allowing the formation of groups consisting of any number of stacked tea bags, limited only by the capacity of the container.

The number of tea bags to be stacked is set via software using the programmable control means. Since the control signals for driving the device are subject only to the reaching of the set number of tea bags counted, the device makes it possible to easily change the number of tea bags making up a group and to automatically respond to the new working parameters without requiring lengthy or complicated mechanical adjustments.

BRIEF DESCRIPTION OF THE DRAWINGS

Further characteristics of the invention according to the abovementioned objects are laid out in the claims below and the advantages of the disclosure are apparent from the detailed description which follows, with reference to the accompanying drawings, which illustrate a preferred embodiment of the invention and in which:

DESCRIPTION OF THE PREFERRED EMBODIMENTS

Figure 1:
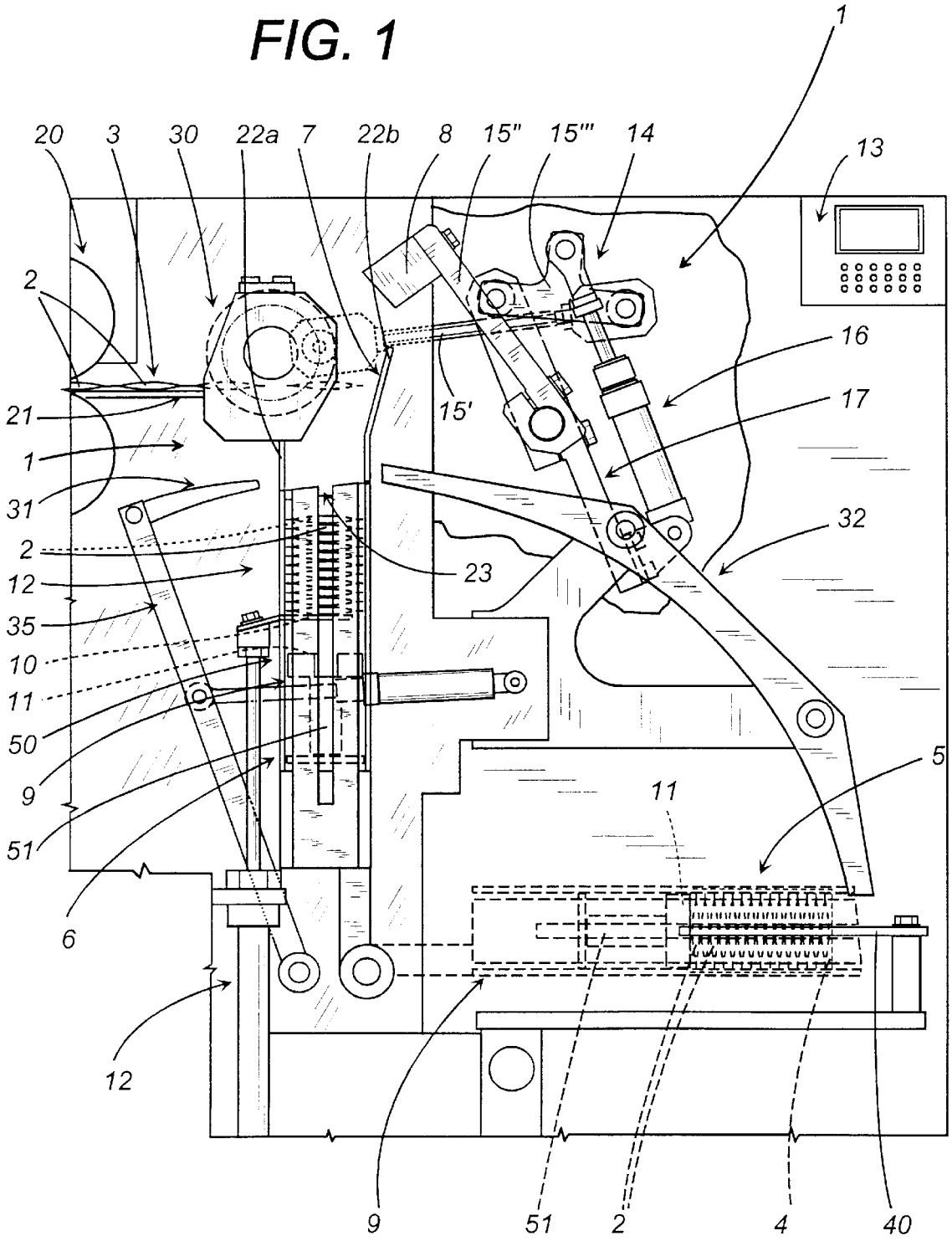
FIG. 1 is a perspective view of the device made according to the present invention illustrated as a whole as mounted, in working conditions, on a packaging machine which is only partly illustrated.

With reference to FIG. 1, the numeral 1 indicates as a whole a device for forming and inserting into cartons 4 groups 2 of products 3 consisting, in this particular embodiment, of filter bags containing tea, chamomile, herbs or other similar infusable products.

The device 1 is located downstream of a cutting station 20 forming part of a tea bag making machine and operates between a horizontal feed line 21 along which the products 3 feeding out of the cutting station 20 move and a cartoning station 5 located below and to the side of the feed line 21.

The device 1 essentially comprises a vertical stacking line 6 located to the side of the cartoning station 5 and equipped with a hopper 7 placed above an elongated container.

The hopper 7 has a product 3 infeed section made in a first wall 22*a* oriented crossways with respect to the feed line 6. The outfeed section, on the other hand, is made on a horizontal bottom 23 adjacent to the container 9.

The hopper 7 is also equipped with a presser 8 mounted by a linkage 14 (see FIGS. 2A through 3B) which makes it move alternately inside the hopper 7 along a substantially circular curved path. The presser 8 operates in synchrony with the tea bag maker in such a way as to intercept, one by one, the products 3 which the hopper 7 receives between the said first wall 22*a* and a second opposite wall 22*b*, also placed crossways, and to push the products 3 towards the outfeed section below. The linkage 14 (see FIGS. 2A through 3B) is of the type with jointed, reciprocally movable elements 15', 15", 15'", 16 and 17. The lengths of these elements and their relative angular positions are such that a rotary input motion applied to them by a drive lever 30, which moves in synchrony with the tea bag maker, results in an angular output swinging motion of predetermined amplitude applied to the presser 8.

Figure 2A:
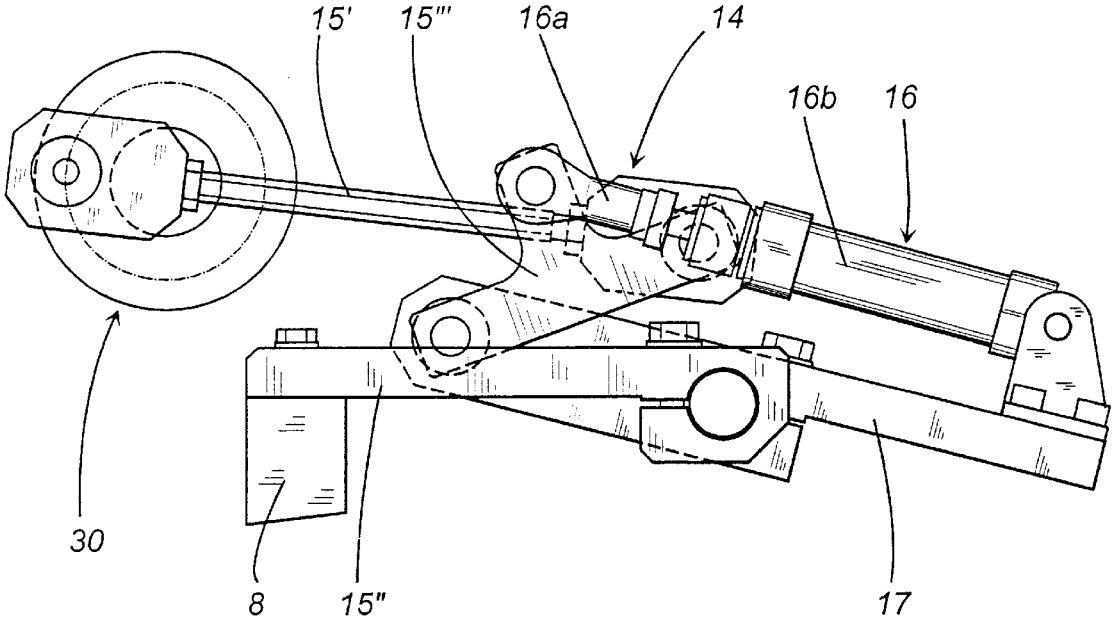
FIGS. 2A through 3B illustrate a mechanism with which the hopper presser is equipped, each showing characteristic positions of the mechanism in a different working state.
Figure 2B:
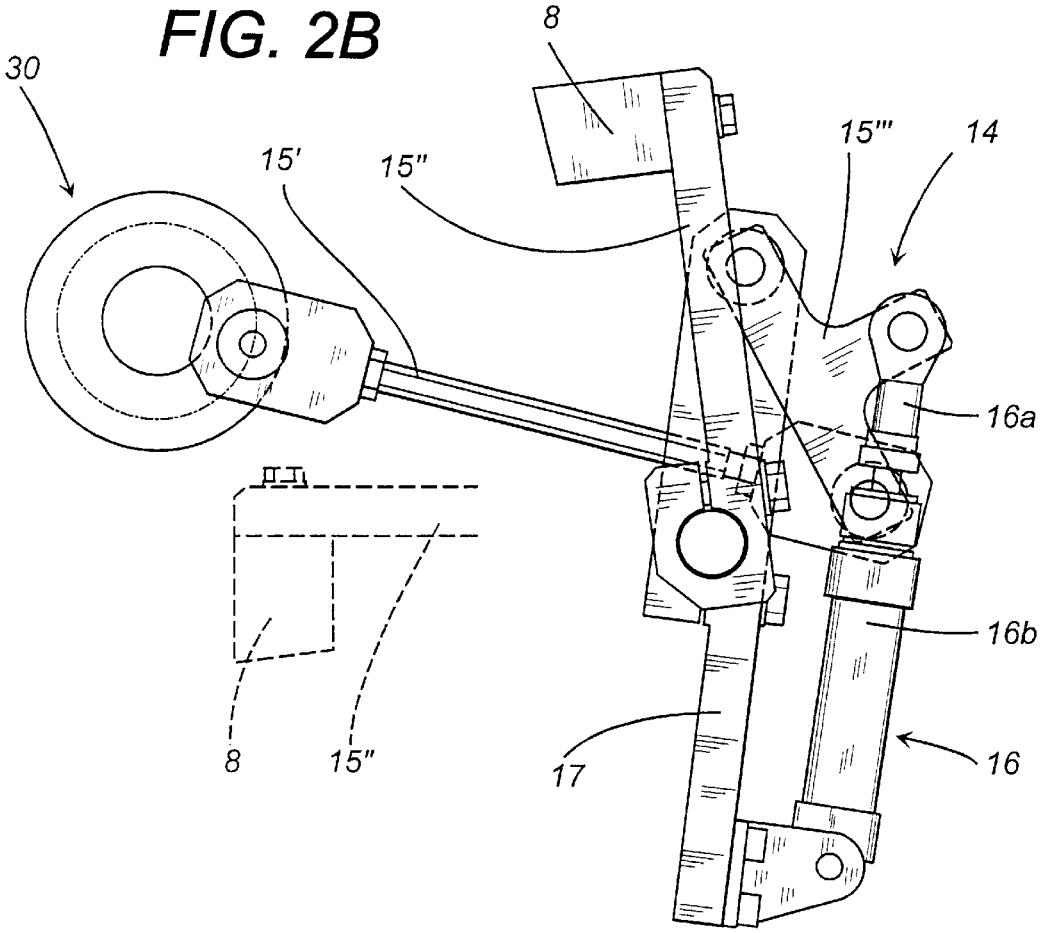
Figure 3A:
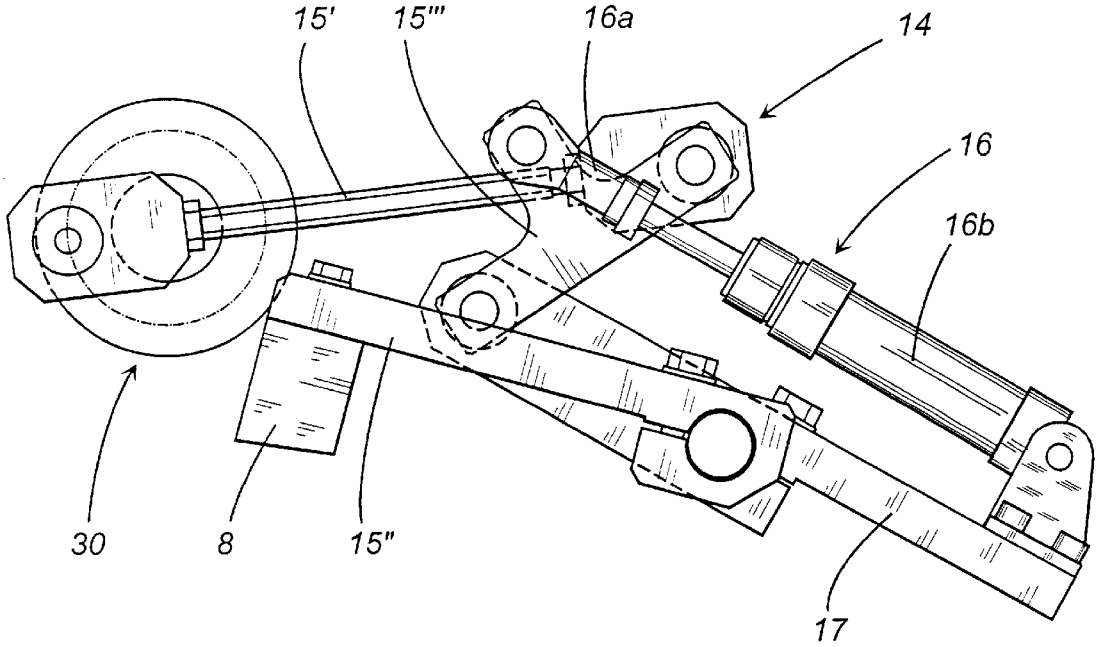
Figure 3B:
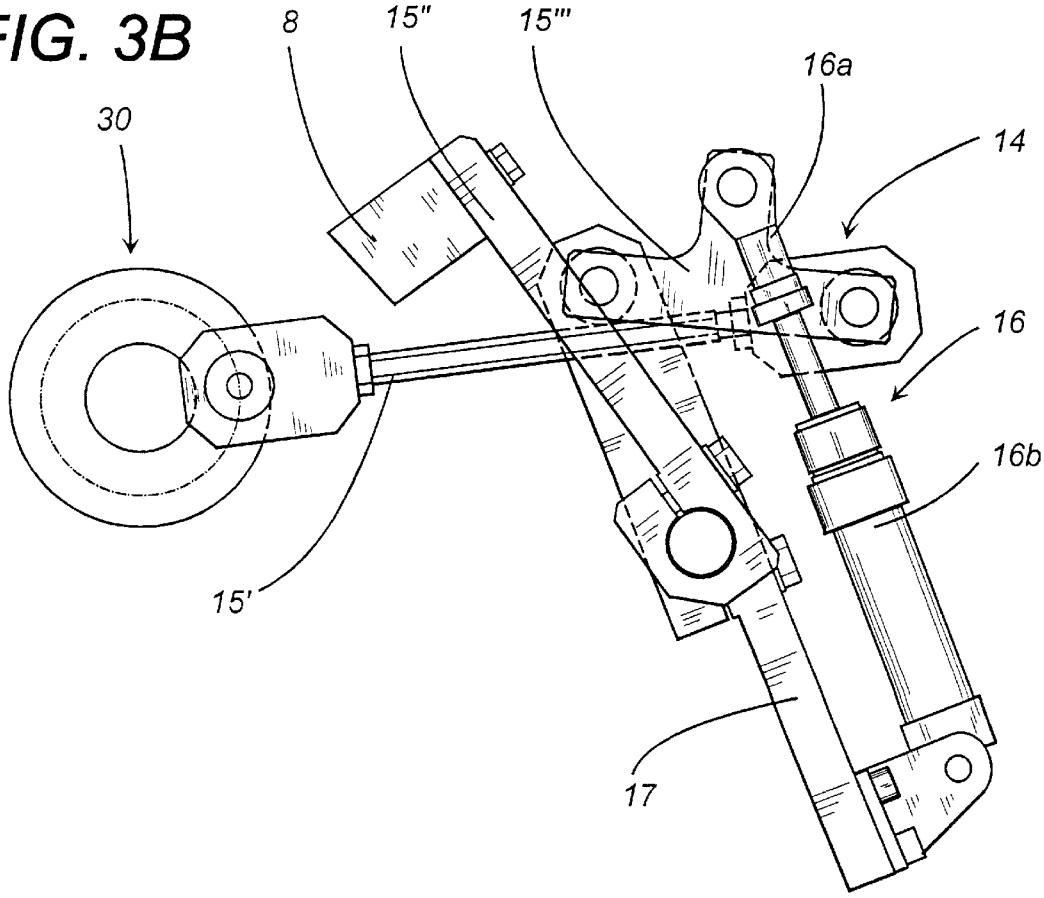

If we compare FIGS. 2A and 2B with FIGS. 3A and 3B, we can see that one of the elements, the one labeled 16, of the linkage 14 is made of two parts 16*a*, 16*b* which can slide one inside the other so as to vary the overall length of the element 16 between the ends where it joins the adjacent elements 15'" and 17.

Consequently, when the element 16 is extended as far as possible (see FIGS. 3A through 3B), the angular path swept by the presser 8 is the shortest; instead, the longest angular path (see FIGS. 2A through 2B) is swept when the parts 16*a*, 16*b* are placed in such a way that the joints of the element 16 are closest together.

The linkage 14 can therefore be used to make the presser 8 effect a longer stroke in relation to the hopper 7 when, for example, it is necessary to compact the products 3 that are already inside the container 9. If the element 16 is a pneumatic cylinder, the stem and the cylinder being represented by the said parts 16*a* and 16*b*, respectively, it is possible to make the presser 8 effect the longest stroke each time the products 3 fed into the hopper 7 reach a preset count. Looking at FIG. 1 again, it can be seen that the hopper 7 is of the controlled outfeed type. This feature is obtained through a cutoff element 31 mounted on the end of a swinging rod 35. The cutoff element 31 moves along a path shaped like a circular arc from an inoperative position in which it is located on the side of the stacking line 6 to a position in which it cuts off the products 3 of the hopper 7 and is located between the hopper 7 and the container 9 below.

FIG. 1 also shows that the container 9 is shaped like a channel with a substantially C-shaped cross section. Outside the container 9, linear actuating means, consisting of a fluid cylinder 12, and synchronized with the motion of the tea bag maker, mount a movable tongue 10 which extends into the container through an open side 50 of it.

When the fluid cylinder 12 is driven, the movable tongue 10 moves along the container 9 and retains the products 3 as they feed out of the hopper 7, thus forming a group 2 of products 3 which grows gradually downwards towards the endwall 11 of the container 9.

Moreover, the end of the container 9 further away from the hopper 7 is mounted in such a way that it can rotate while remaining in contact with an arc-shaped closing element 32 which is attached to the side of the hopper 7 and extends from the stacking line 6 to the cartoning station 5.

At the cartoning station 5, there is an extraction blade 40 mounted next to the container 9. The blade 40 is driven into the container 9, pulls all the products 3 out through an open wall 51 of the container 9 and transfers them to the carton 4 while the horizontal top of the carton is kept open at the cartoning station at a position adjacent to the extraction blade 40.

Lastly, the device 1 comprises programmable control means 13 which are interfaced with the device 1 so as to synchronize the sequence of movements of the movable parts.

During use, the control means 13, consisting, for example, of a conventional PLC, make it possible to set and store a reference value of the number of products 3 to be stacked in the container 9 to form the groups 2. An encoder (not illustrated) forming part of the tea bag maker can be used to count the products 3 fed to the device 1.

When the reference value set on the PLC is reached, the control means 13 apply a drive signal to the linkage 14 so that the stroke of the presser 8 in the hopper 7 is the longest possible and the group 2 of products 3 is compressed against the endwall 11 of the container 9. This also causes the means that actuate the tongue 10 to reach the end of stroke condition.

This end of stroke condition provides the signal to enable the activation of the cutoff element 31 which closes the hopper 7. Immediately after this, another drive signal moves the container 9 to the cartoning station 5 while the group 2 of tea bags 3 it contains is held between the endwall 11 of the container 9 and the closing element 32.

When the cartoning station 5 is reached, a limit switch (not illustrated) is triggered to enable the blade 40 to transfer the group 2 to the carton 4.

Once this operation has been completed, the return of the blade 40 to its initial position provides the control means 13 with the signal to enable the container 9 to return to the initial position under the hopper 7. When the hopper opens again, the tea bags 3 that have accumulated inside it in the meantime are transferred to the container 9 and the sequence of operations described above is repeated.

It should be noticed that the time taken by the container 9 to move to the cartoning station and back is independent of the preset number of tea bags 3 in each group 2. For this reason, it is extremely easy to set the device 1 to form groups 2 containing different numbers of tea bags 3 by simply changing the PLC input value that defines the number of tea bags 3 to be stacked.

Apart from that, the only mechanical adjustment required to adapt the device 1 to the new and different packaging parameters is changing the capacity of the container 9 by moving the endwall 11 according to the larger or smaller number of tea bags 3 to be stacked. The invention described can be subject to modifications and variations without thereby departing from the scope of the inventive concept. Moreover, all the details of the invention may be substituted by technically equivalent elements.

What is claimed:

1. In a packaging machine, a device to form groups of products placed in contact with each other and to insert the groups into cartons at a cartoning station, said device comprising:

a stacking line, located next to the cartoning station and equipped with a controlled outfeed hopper in which an alternating product presser operates;

a container located at a bottom of said hopper and moving alternatively from a first position in which it is connected with the hopper to a second position in which it is connected with the cartoning station where the groups are extracted from the container and transferred to the carton, after which the container returns to the first position connected with the hopper;

a tongue, disposed and movable within the container and adapted for retaining products as they leave the hopper so as to form a group of products that grows downwardly toward an endwall of the container;

means for detecting the number of products received by the container;

linear means for actuating at least the tongue, said linear means adapted for providing a signal when a preset reference value defining the number of products in a group is reached, according to the number provided by the detecting means; and, programmable control means for receiving the preset reference value and for activating the closing of the hopper and the motion of the container to the cartoning station according to the signal provided by the linear means.

2. The device according to claim 1 wherein the linear means for actuating the tongue are driven by a fluid medium.

3. The device according to claim 1 wherein the presser is actuated by the programmable control means and performs an alternate variable stroke relative to the hopper, the amplitude of the stroke varying when the preset reference value is reached so as to press the group against the endwall of the container.

4. The device according to claim 3 wherein the presser is actuated by a linkage comprising movable elements having jointed ends, at least one of said movable elements varying the distance between its jointed ends according to the programmable control means.

5. The device according to claim 4 wherein the movable element varying the distance between its jointed ends comprises a stem and a cylinder containing a drive fluid.

* * * * *